US005669794A

United States Patent [19]

Knight et al.

[11] Patent Number: 5,669,794

[45] Date of Patent: Sep. 23, 1997

[54] APPARATUS FOR MOUNTING A MOTOR TO A BOAT

[75] Inventors: Steven J. Knight, Union Grove; Mark J. Sarder, Waukesha; William R. Baumann, Wauwatosa, all of Wis.

[73] Assignee: Johnson Worldwide Associates, Inc., Sturtevant, Wis.

[21] Appl. No.: 575,127

[22] Filed: Dec. 19, 1995

[51] Int. Cl.[6] ..... B63H 5/12

[52] U.S. Cl. ..... 440/63; 440/900; 248/642

[58] Field of Search ..... 440/53, 55, 61–63, 440/900, 6; 248/640–643; 74/475, 494, 495, 527, 480 B; 114/144 R

[56] References Cited

U.S. PATENT DOCUMENTS

| | | | |
|---|---|---|---|
| 1,703,099 | 2/1929 | Craddock . | |
| 3,119,365 | 1/1964 | Evans . | |
| 3,377,978 | 4/1968 | Tillman . | |
| 3,462,102 | 8/1969 | Rivers | 248/641 |
| 3,698,672 | 10/1972 | Gilbert . | |
| 3,724,790 | 4/1973 | Harris et al. . | |
| 3,861,348 | 1/1975 | Beierle | 440/6 |
| 3,915,417 | 10/1975 | Norton et al. . | |
| 4,019,703 | 4/1977 | Meredith et al. . | |
| 4,033,530 | 7/1977 | Harris . | |
| 4,094,482 | 6/1978 | Weaver . | |
| 4,175,724 | 11/1979 | Bauman . | |
| 4,268,258 | 5/1981 | Beem . | |
| 4,548,586 | 10/1985 | Phillips . | |
| 4,555,233 | 11/1985 | Klammer et al. . | |
| 4,729,745 | 3/1988 | Edwards . | |
| 4,734,068 | 3/1988 | Edwards . | |
| 4,819,905 | 4/1989 | McCain . | |
| 4,872,859 | 10/1989 | Griffiths et al. | 440/53 |
| 4,911,398 | 3/1990 | DiIulio . | |
| 4,955,834 | 9/1990 | Henderson et al. . | |
| 4,966,566 | 10/1990 | Baird . | |
| 5,112,258 | 5/1992 | Folsom . | |
| 5,116,267 | 5/1992 | Olson . | |
| 5,382,183 | 1/1995 | Rompré | 248/641 |

FOREIGN PATENT DOCUMENTS

| | | | |
|---|---|---|---|
| 3723481 | 1/1989 | Germany | 440/63 |
| 923367 | 4/1963 | United Kingdom . | |

*Primary Examiner*—Edwin L. Swinehart
*Attorney, Agent, or Firm*—Foley & Lardner

[57] ABSTRACT

A motor mount for attaching a motor, such as a trolling motor, to a boat includes a bracket, a pair of pivotable support arms and a motor support. The bracket may be removably attached to the transom or to the bow of a boat. The bracket, the support arms and the motor support form a 4-bar linkage that permits the motor to be moved between a fully deployed or lowered position and a fully stowed or raised position. As the motor is moved between the deployed and stowed positions, it moves through a first, generally vertical translation phase of motion during which it maintains a generally vertical orientation, and a second, generally pivotal phase, in which it is rotated from the generally vertical orientation to a generally horizontal orientation. An intermediate stowed position is provided just beyond a transition point between the two phases of motion. The mount facilitates temporary removal of the motor from the water, such as for displacement of the boat between fishing spots, without requiring adjustment of the motor depth and without subjecting the motor mounting tube to excessive bending moments due to cantilevered extension of the motor.

16 Claims, 5 Drawing Sheets

APPARATUS FOR MOUNTING A MOTOR TO A BOAT

FIELD OF THE INVENTION

The present invention relates to an improved motor mount for securing an outboard motor, such as a trolling motor to a boat. In particular, the present invention relates to a motor mount that facilitates movement of a motor out of the water to an intermediate stowed position.

BACKGROUND OF THE INVENTION

A number of different retractable mounting devices have been proposed and are currently available for securing a motor, such as a trolling motor, to a boat. Such devices have become extremely popular, particularly in sport fishing, and typically permit the motor to be positioned in a deployed or lowered position in which the motor is oriented generally vertically outboard of the boat, and a typically horizontal stowed position, over the boat deck.

In one type of known motor mounting device, the motor is secured in a support that is pivotally attached to a mounting bracket designed to be fixed to the transom or the bow of the boat. The motor support typically engages a tube connecting the head of the motor to a lower propulsion unit. The motor support may be pivoted with respect to the mounting bracket about a horizontal pivot axis to raise the propulsion unit to the stowed position or lower the unit to the deployed position. Motor mounting devices of this general type are described in U.S. Pat. Nos. 4,268,258; 4,019,703; 3,724,790; and 3,698,672.

In another type of motor mount a support bracket is attached to the boat in a substantially horizontal orientation. A pair of channel members are pivotally connected to the bracket at one end and to a motor support at the opposite end to form a four-bar linkage. The channel members are typically relatively long to permit the motor to be held in a vertical, deployed position, and displaced in a broad, sweeping movement to a stowed position well inboard of the deployed position. Sliding movement is also commonly provided via the channel members to permit breakaway pivotal movement of the motor upon impact with submerged objects. Mounting devices of this general type are described in U.S. Pat. Nos. 4,966,566; 4,819,905; 4,555,233 and 3,915,417.

While such motor mounts have proven satisfactory for certain situations, particularly during normal use and transport, they are not without drawbacks. For example, at times a user may desire to withdraw the motor from the water temporarily, such as during movement of the boat between fishing spots on a lake. Thus, the user will typically raise a trolling motor and use a larger motor to more quickly move the boat between spots. If the trolling motor is held in a pivoting motor mount of the type described above, simple pivotal movement of the mount positions the motor propulsion unit, which may be fairly heavy when out of the water, in a cantilevered position well outboard of the boat. To avoid damage to the motor shaft during transport, the user may be required to reposition the motor (e.g. slide the motor tube) in the motor support. Such repositioning is inconvenient, however, in that it requires the user to reset the depth of the motor once the boat reaches the next fishing spot. If, on the other hand, the motor is held in a four-bar linkage type mount of known design, it must generally be moved fully inboard to its stowed position, requiring substantial displacement of the motor and mount. Moreover, such devices are typically too extended and weighty to permit intermediate stowed positions. In either case, movement of the motor is either purely or substantially pivotal.

There is a need, therefore, for an improved motor mount that permits the motor to be easily and conveniently moved out of the water, such as for temporary transport, without requiring the user to reposition the motor in the mount or to bring the motor fully inboard.

SUMMARY OF THE INVENTION

The present invention features an innovative motor mount designed to respond to these needs. The mount permits the user to move the motor from its deployed position through a substantially vertical translation phase in which the propulsion unit of the motor is raised out of the water. In a second phase of movement, the motor is pivoted to a substantially horizontal position with little further vertical translation. A stable intermediate locked position is provided to allow the user to leave the motor raised out of the water without requiring the mount to be moved through its full range to its fully stowed position. The intermediate position preferably corresponds to a location of the motor in the second or pivotal phase of movement.

Thus, in accordance with a first aspect of the invention, a mount for a securing a motor to a boat comprises a mounting bracket, first and second link arms, a motor support and a locking mechanism. The mounting bracket is adapted to be secured to the boat and includes first and second pivot supports. The first and second link arms are pivotally supported on the first and second pivot supports respectively. The motor support is adapted to receive and hold a portion of the motor, the motor support being pivotally supported on the first and second link arms and movable with the link arms between a deployed position and a stowed position. The locking mechanism permits the motor support to be selectively maintained in at least three stable positions including the deployed position, the stowed position and at least one intermediate position between the deployed and stowed positions.

In accordance with another aspect of the invention, an apparatus for securing an outboard motor, such as a trolling motor, to a boat comprises a mounting bracket, upper and lower link arms and a motor support. The mounting bracket is adapted to be fixed to the boat and includes first and second pivot supports. The upper and lower link arms are pivotally coupled to the first and second pivot supports respectively. The motor support is configured to receive and support a portion of the motor and is pivotally coupled to the upper and lower link arms. The motor support is movable with the link arms between a lowered position and a raised position. The link arms move the motor support through first and second phases of movement between the lowered position and the raised position, such that a motor mounted in the motor support undergoes substantially vertical translation during the first phase of movement and substantially pivotal translation during the second phase of movement.

In accordance with a further aspect of the invention, an apparatus for mounting a motor to a boat comprises first, second, third and fourth members. The first member is coupled to the boat, while the second member is coupled to the motor. The third member has a first end pivotally coupled to the first member at a first pivot axis and a second end pivotally coupled to the second member at a second pivot axis. The fourth member has a first end pivotally coupled to the first member at a third pivot axis and a second end pivotally coupled to the second member at a fourth pivot axis. The first pivot axis is located substantially vertically above the third pivot axis. The first, second, third and fourth members cooperate to selectively move the motor between a deployed position wherein the motor is in a substantially vertical orientation and a stowed position wherein the motor is in a substantially horizontal orientation.

BRIEF DESCRIPTION OF THE DRAWINGS

The present invention will become more fully understood from the following derailed description, taken in conjunction with the accompanying drawings, wherein like reference numerals refer to like parts, in which.

DETAILED DESCRIPTION OF THE PREFERRED EMBODIMENTS

Figure 1:
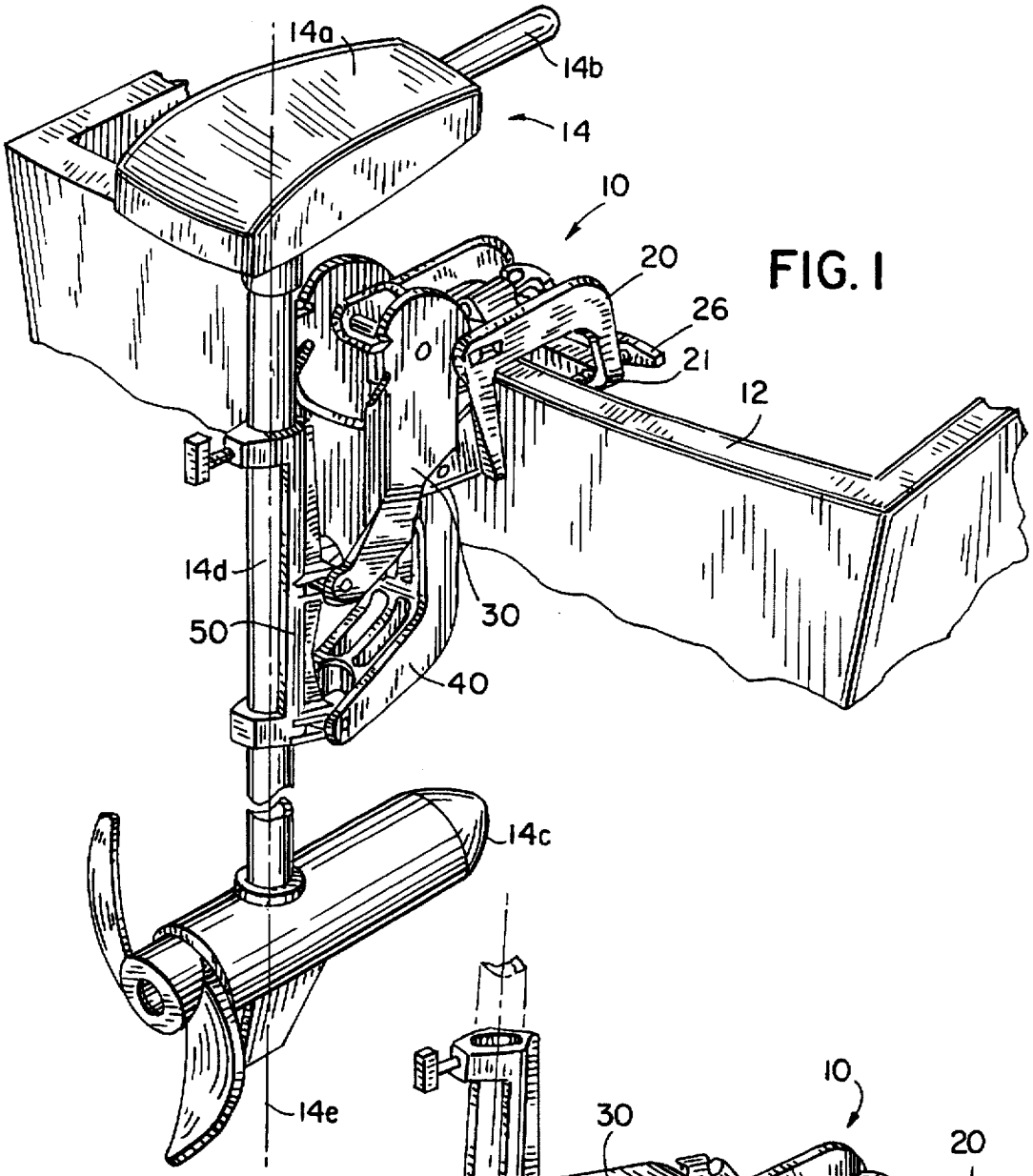
FIG. 1 is a perspective view of an exemplary motor mount shown fixed to the transom of a boat and supporting a trolling motor in a fully-deployed or operating position.

Referring now to the drawings and referring first to FIG. 1, a motor mount 10 is illustrated secured to the transom 12 of a boat. Retained within motor mount 10 is a trolling motor 14, shown as consisting of a motor head **14*a*, including a tiller 14*b*, and a propulsion unit 14*c* coupled to one another by a tubular motor shaft 14*d*. Trolling motor 14 is shown in FIG. 1 in its deployed or lowered position wherein propulsion unit 14*c* is held below the surface of water on which the boat floats. Motor mount 10 includes a mounting bracket 20, an upper link arm 30, a lower link arm 40 and a motor support 50**.

Figures 2, 2A:
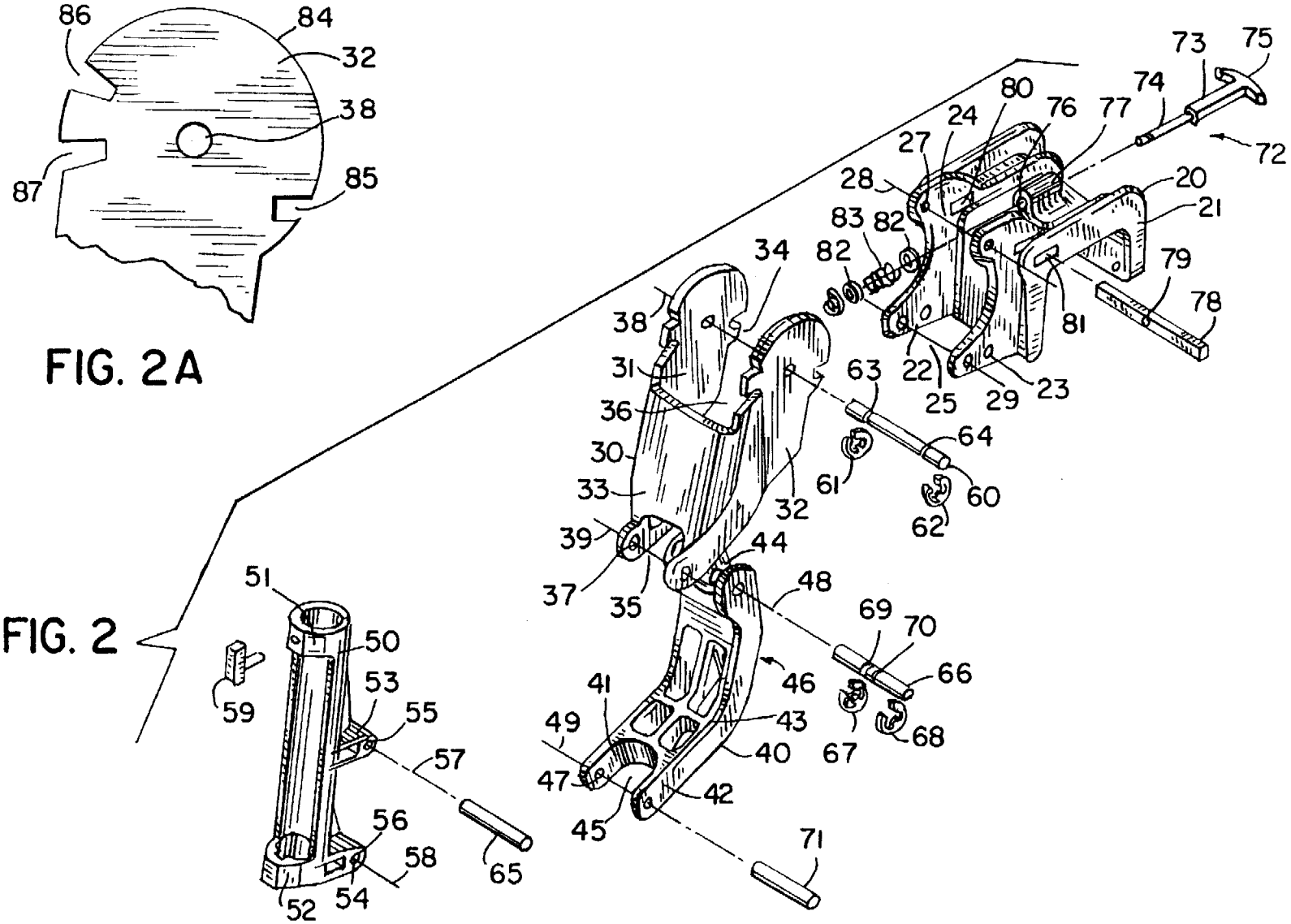
FIG. 2 is a perspective exploded view of the motor mount of FIG. 1.
FIG. 2A is detail view of an upper arm of the motor mount of FIG. 1.

As best illustrated in FIG. 2, mounting bracket 20 includes a clamp 21 and a pair of side flanges 22 and 23 forming an upper mounting clevis 24 and a lower mounting clevis 25. Clamp 21 preferably includes one or more handled bolts 26 (see FIG. 1) that can be tightened against transom 12 to secure mounting bracket 20 to transom 12, in a manner generally known in the art. Upper mounting clevis 24 and lower mounting clevis 25 each have a pair of aligned upper and lower apertures (shown typically as 27) extending through side flanges 22 and 23, defining pivot axes 28 and 29 respectively. Lower mounting clevis 25 has a second inner pair of apertures that allow an alternative mounting position available if motor mount 10 is to mounted to the bow of the boat as described below.

Upper arm 30 includes side flanges 31 and 32 joined by a web portion 33 to form an upper clevis 34 and a lower clevis 35. A recess 36 is formed in an area between side flanges 31 and 32 and beneath web 33. Upper clevis 34 and lower clevis 35 each have a pair of aligned apertures (shown typically as 37) extending through side flanges 31 and 32 to define pivot axes 38 and 39 respectively. Upper arm 30 has a slightly curved or angled configuration whereby axis 38 is disposed slightly outboard of axis 37 in the fully deployed position of mount 10 as discussed below.

Lower arm 40 includes side flanges 41 and 42 coupled by a front web 43 to form an upper clevis 44 and a lower clevis 45. Flanges 41 and 42, together with web 43 form a recess 46. Upper clevis 44 and lower clevis 45 each have a pair of aligned apertures (shown typically as 47) extending through flanges 41 and 42 to define pivot axes 48 and 49. Like upper arm 30, lower arm 40 has a generally arcuate or angled configuration such that axis 49 is disposed slightly outboard of axis 48 when mount 10 is in its deployed position.

Motor support 50 includes an upper collar 51 and a lower collar 52 for receiving and supporting motor shaft **14*d*. Motor support 50 also includes an upper frame extension 53 and a lower frame extension 54, each having a throughhole 55 and 56, respectively, defining pivot axes 57 and 58. Motor shaft 14*d* is slidingly received within upper and lower collars 51 and 52, and may be fixed at a desired depth by a handled bolt 59 received within upper collar 51, or a similar clamping arrangement. Collars 51 and 52 thus allow motor 14 to be raised and lowered along a longitudinal axis 14*e* of motor shaft 14*d* and held securely in place by tightening bolt 59**.

Upper clevis 34 of upper arm 30 is pivotally coupled to upper mounting clevis 24 of mounting bracket 20 with a first pivot pin 60 which extends through the corresponding apertures of clevises 34 and 24 to align pivot axes 28 and 38. Pin 60 is retained in the clevises via e-rings 61 and 62 which fit within corresponding locking grooves 63 and 64 formed in first pivot pin 60. Upper mounting clevis 24 of mounting bracket 20 is thereby retained within upper clevis 32 of upper arm 30, and upper link arm 30 is free to pivot about axes 28, 38 as is shown more clearly in FIGS. 3, 4 and 5. Lower clevis 35 of upper arm 30 is pivotally coupled to upper frame extension 53 of motor support 50 with a second pivot pin 65 which extends through the corresponding apertures in clevis 35 and extension 53. Pin 65 is retained via a groove and e-ring arrangement (not shown) similar to that described above with respect to pin 60. Upper frame extension 53 of motor support 50 is thereby retained within the lower clevis 35 of upper arm 30 and is pivotal about axes 39, 57.

Figure 3:
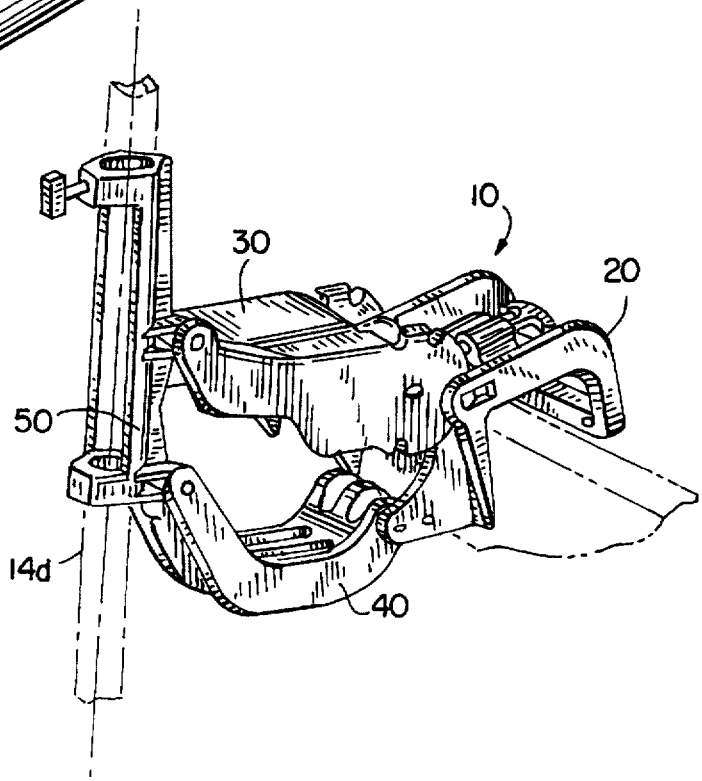
FIG. 3 is a perspective view of the motor mount of FIG. 1 moved through a first phase of movement in which the motor undergoes substantially vertical translation.
Figure 4:
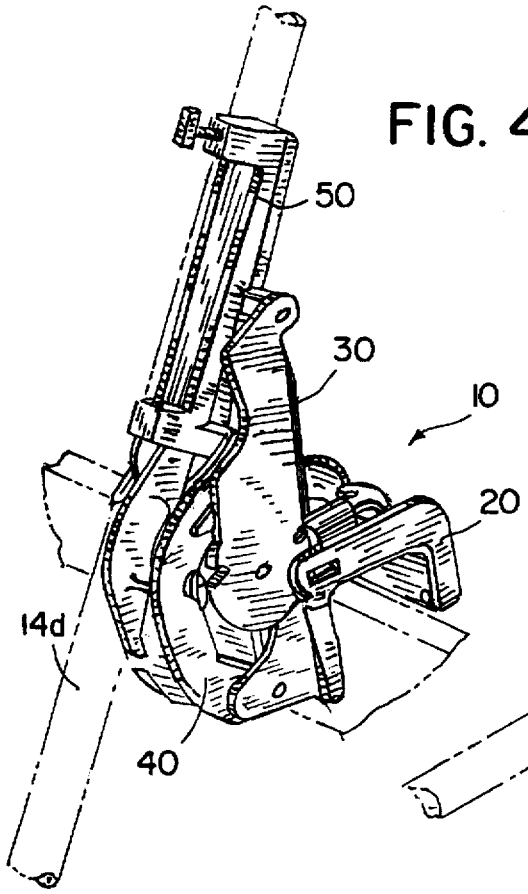
FIG. 4 is a perspective view of the motor mount of FIG. 1 in an intermediate locked position.
Figure 5:
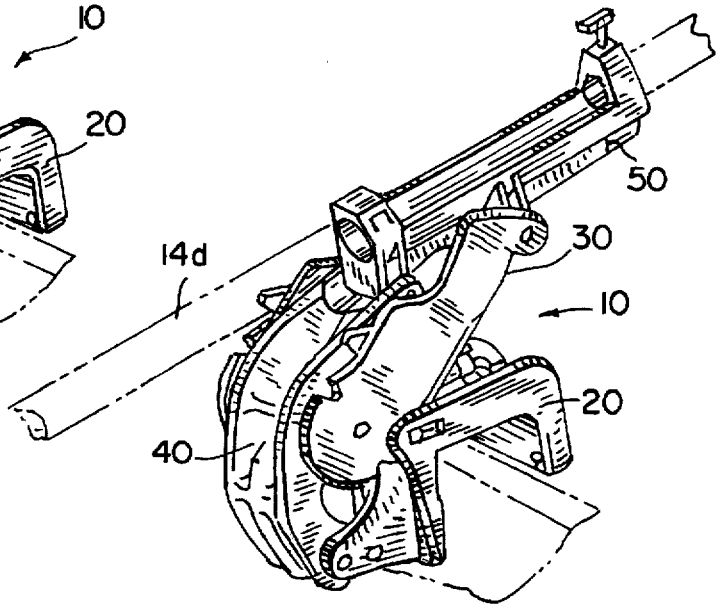
FIG. 5 is a perspective view of the motor mount of FIG. 1 in a fully-stowed or raised position.

Upper clevis 44 of lower arm 40 is pivotally coupled to lower mounting clevis 25 of mounting bracket 20 via a third pivot pin 66 which extends through the corresponding apertures to align axes 29 and 48. Pin 66 is retained by an arrangement of e-rings 67 and 68 that fit within corresponding locking grooves 69 and 70, respectively. Upper clevis 44 of lower arm 40 is thereby retained within lower mounting clevis 25 of mounting bracket 20 and is pivotal within clevis 25, as is shown in FIGS. 3 to 5. Lower clevis 45 of lower arm 40 is pivotally coupled to lower frame extension 54 of motor support 50 via a fourth pivot pin 71 which extends through the corresponding apertures along aligned pivot axes 49, 58. A groove and ring arrangement similar to that described above retains pin 71 in engagement. Lower frame extension 54 of motor support 50 is thereby retained within the lower clevis 45 of lower arm 40 and is pivotable about axes 49, 58, as is shown in FIGS. 3 to 5.

In a particularly preferred embodiment of mount 10, mounting bracket 20 also includes a locking and release handle assembly 72 which selectively retains upper arm 30 (and therefore motor support 50 and trolling motor 14) in a various stable positions. Release handle assembly 72 includes a release handle 73, itself including a draw shaft 74 and a handle 75. Draw shaft 74 is received through a bore 76 within a guide 77 formed on an upper surface of mounting bracket 20. Locking and release handle assembly 72 also includes an elongated locking bar 78 fixed to draw shaft 74 via a central aperture 79. Locking bar 78 is oriented generally perpendicularly to shaft 74 and extends through guide slots 80, 81 formed in sides of bracket 20. Locking bar 78 is free to slide within guide slots 80, 81 as handle 73 is slid within guide 77. Handle assembly 72 further includes a biasing assembly, including a pair of washers 82 and a compression spring 83 that extends between and bears against guide 77 and locking bar 78 to urge locking bar 78 in an outboard direction.

Locking and release handle assembly 72 permits mount 10 to be positioned in various stable and locked positions as described in greater detail below. To support mount 10 in these various locked positions, locking bar 78 cooperates with detents formed around the periphery of upper clevis 34 of upper arm 30. As illustrated in FIG. 2A, in the presently preferred embodiment, flanges 31 and 32 of upper arm 30 have a generally round periphery 84 surrounding axis 38. A series of detent notches 85, 86 and 87 are formed in periphery 84 for receiving locking bar 78. Thus, as arm 30 is pivoted about axis 38, locking bar 78 glides along periphery 84, biased by spring 83. When arm 30 reaches positions wherein locking bar 78 overlies a notch 85, 86, 87, locking bar 78 is urged into the notch to maintain mount in the corresponding stable position. Bar 78 may then be withdrawn from the notch by pulling handle 75 rearwardly. As described below, in the presently preferred embodiment, notches 85, 86 and 87 correspond to fully deployed, intermediate stowed and fully stowed positions of mount 10, respectively.

As shown by FIGS. 1, 3, 4 and 5, mounting bracket 20, upper arm 30 and lower arm 40 and motor support 50 can be viewed as links forming a pivotally-coupled four-bar linkage. This four-bar linkage is configured to allow a particularly advantageous pivotal movement of trolling motor 14 through a plurality of positions, including: (1) a fully deployed, or lowered position (shown in FIG. 1); (2) an intermediate stowed position (shown in FIG. 4); and (3) a fully stowed or raised position (shown in FIG. 5). Movement between these positions is coordinated by the relative movements of the four-bar linkage employed in motor mount 10. Arms 30 and 40 also advantageously permit some degree of nesting of the mount elements, whereby lower arm 40 fits partially within arm 30 and motor support 50 fits partially within lower arm 40. Moreover, as mount 10 is moved through its various stable positions, trolling motor 14 is translated through two distinct phases of motion, including a substantially vertical translation phase and a substantially pivotal translation phase. In the vertical translation phase, motor 14 is raised from (or lowered into) the water while remaining in a generally vertical orientation. In the pivotal translation phase, motor 14 is pivoted from the generally vertical orientation to a substantially horizontal orientation for stowing. These phases of movement are discussed more fully below.

In the fully deployed position shown in FIG. 1, motor support 50 is positioned in a substantially vertical orientation. Trolling motor 14 is thus in position to power the boat via propulsion unit 14*c* in a manner well known in the art. In this position, locking bar 78 is urged into detent notches 85 of upper arm 30 to maintain the mount in position against thrust forces exerted by propulsion unit 14*c*. When a user desires to raise motor 14 from the water, such as during periodic displacements of the boat between fishing locations, mount 10 may be moved from the fully deployed position by pulling handle 75 rearwardly to disengage locking bar 78 from notches 85. Motor 14 and mount 10 are then free to move from the fully deployed position, through a substantially vertical translation phase, to the intermediate stowed position shown in FIG. 4.

Due to the arrangement of the linkages of mount 10, a relatively marked kinematic transition occurs in the movement of motor 14 between the vertical translation and pivotal translation phases of movement. This transition occurs at approximately the position illustrated in FIG. 3. The intermediate stowed position shown in FIG. 4 is preferably slightly beyond (i.e. closer to the fully stowed position) this transition point. In the intermediate stowed position, locking bar 78 is urged into detent notches 86 on upper arm 30 to maintain motor 14 in this position against the weight of propulsion unit 14*c* and other forces that may be exerted on mount 10. The intermediate stowed position provides the user an convenient alternative between the fully deployed and fully stowed position in which motor 14 is effectively withdrawn from the water without the need to alter the operating depth of propulsion unit 14*c* within motor support 50. Moreover, it should be noted that in the intermediate stowed position, motor 14 remains in a somewhat vertical orientation, thereby subjecting tube 14*d* to lower bending stresses than in conventional pivoting mounts, wherein tube 14*d* would be oriented more horizontally to attain the same vertical rise of propulsion unit 14*c*, resulting in highly cantilevered loading of tube 14*d*.

When the user desires to lower propulsion unit 14*c* back into the water, he need only pull handle 75 rearwardly, releasing locking bar 78 from notches 86. On the other hand, the user may move mount 10 to the fully stowed position by pulling handle 75 and urging head unit 14*a* of motor 14 downwardly. Once mount 10 reaches the position shown in FIG. 5, locking bar 78 is urged into detent notches 87 on upper arm 30 to lock mount 10 in the fully stowed position. The user may then desire to slide tube 14*d* within support 50 to move propulsion unit 14*c* closer to mount 10, such as for roading or more permanent stowing.

Figure 6:
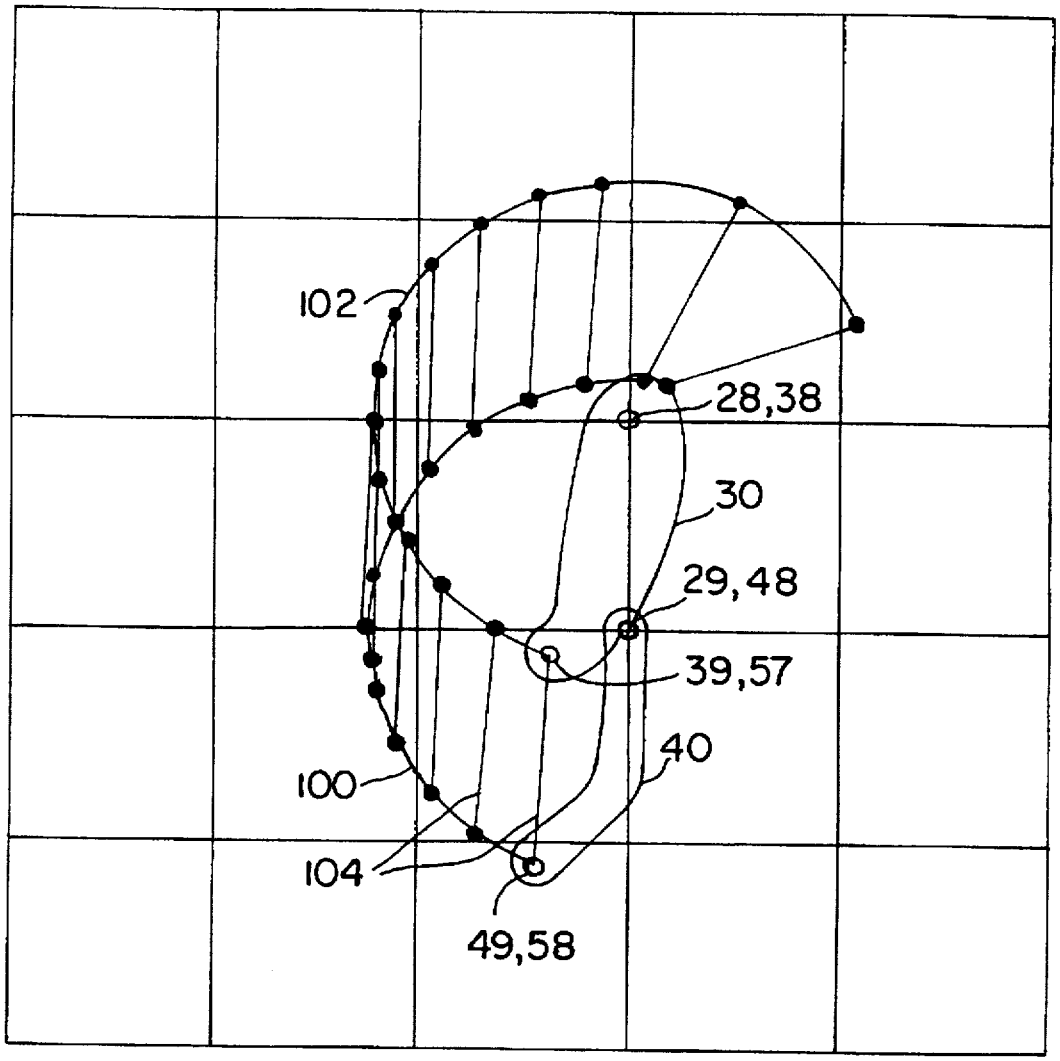
FIG. 6 is a graphical plot illustrating movement of an upper arm and a lower arm of the motor mount of FIG. 1 as the motor mount is moved between its deployed position and its stowed position.
Figure 7:
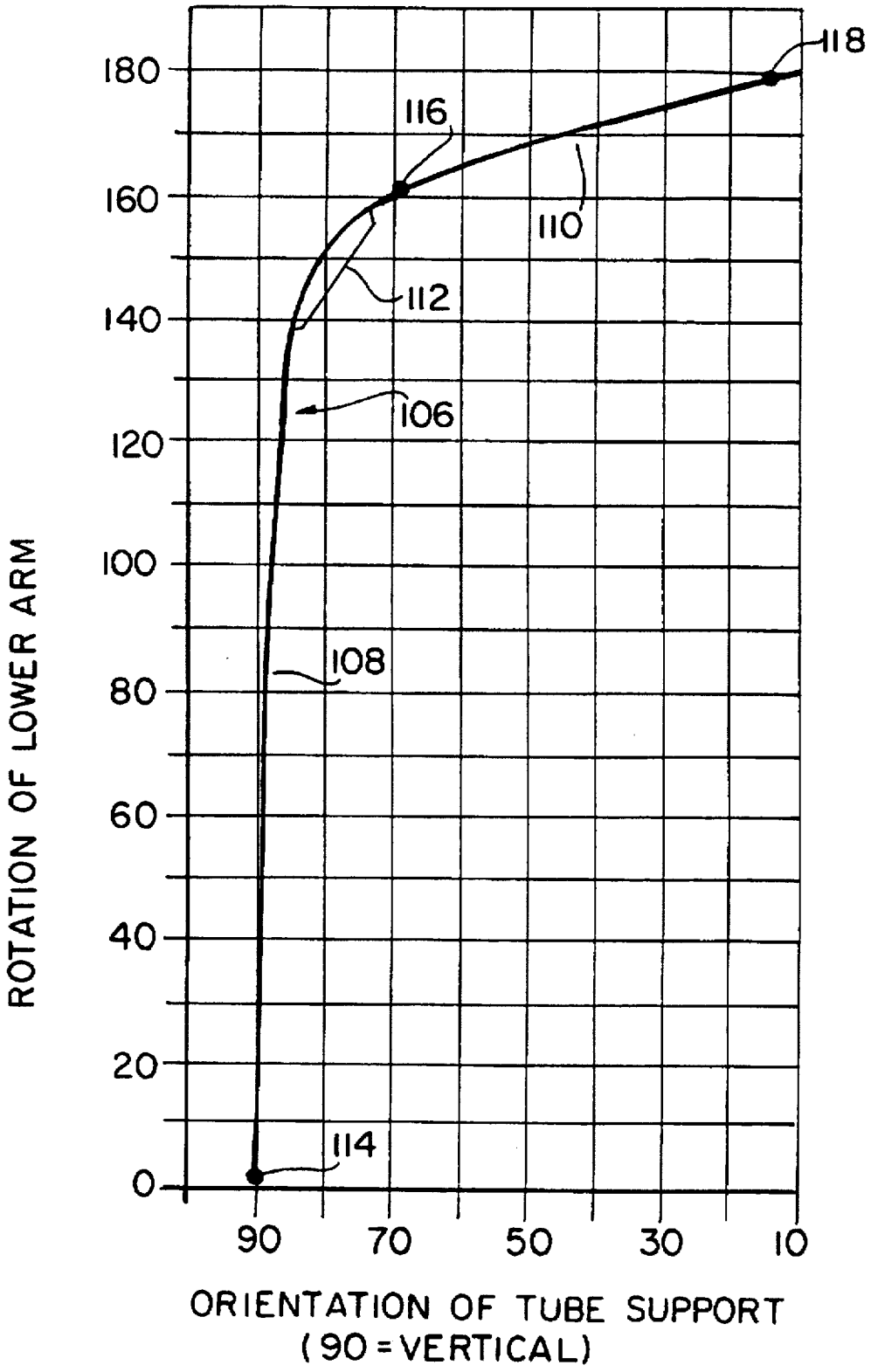
FIG. 7 is a graphical plot of the relationship between the rotational position of the lower arm of the mount of FIG. 1 and the rotational position of the motor mount as the motor is moved between its deployed position and its stowed position.

FIGS. 6 and 7 graphically illustrate the movement of motor 14 and mount 10 through the various positions and translation phases discussed above. As shown in FIG. 6, as lower arm 40 moves between its fully deployed and fully stowed positions about axes 29 and 48, pivot axes 49 and 58 along which lower extension 54 support 50 is mounted trace a circular path 100. Similarly, as upper arm 30 is rotated about axes 28, 38, pivot axes 39 and 57 along which upper extension 53 is mounted trace a second circular path 102. Line segments 104 in FIG. 6 represent the orientation of support 50 and tube 14*d* as arms 30 and 40 are pivoted through their respective ranges of motion. As illustrated in FIG. 6, motor mount 50 and motor 14 are translated substantially vertically, while remaining in a generally vertical orientation throughout much of the range of motion of arms 30 and 40. Once arms 30 and 40 reach a point in which support 50 is approximately above axes 28 and 38, however, further movement of arms 30 and 40 cause generally pivotal movement of support 50 and motor 14.

In FIG. 7, curve 106 graphically illustrates the orientation of support 50 as lower arm 40 is rotated between its fully deployed and its fully stowed positions. Curve 106 includes a substantially vertical section 108 corresponding to the first, vertical translation phase of movement of support 50 described above, joined to an angled or more horizontal section 110 corresponding to the pivotal phase of movement described above. The transition between the vertical translation phase and the pivotal translation phase of movement is represented generally in FIG. 7 by a knee or transition zone 112 of curve 106. As described above, in the presently preferred embodiment, mount 10 may be locked or maintained in at least three stable positions, including the fully deployed position, represented by point 114 in FIG. 7, an intermediate stowed position, represented by point 116 and a fully stowed position, represented by point 118. In the presently preferred embodiment, mount 50 is oriented at approximately 20 degrees from the vertical in the intermediate stowed position, and at approximately 80 degrees from the vertical in the fully stowed position. The vertical translation phase of motion lifts the motor approximately 14 inches vertically from its filly deployed position.

While the present invention has been described in connection with the preferred embodiments, the invention may be variously embodied and its scope is to be limited solely by the scope of the claims which follow. For example, while the structure described above is particularly suited for mounting a trolling motor to the transom of a boat, the mount is generally adapted for alternatively mounting a motor to the bow of a boat (such as through the provision of two or more sets of aligned apertures defining pivot axis 29 at the base of bracket 20. In addition, while the structure described above includes a motor tube support in which a trolling motor tube is slidingly received, other motor support hardware may be envisioned in the place of this support without substantively altering the function of the mount. For example, the mount may be adapted to receive an omnidirectional breakaway mounting device in place of the tube support. One such device of this type is commercially available from JWA Fishing and Maxine of Sturtevant, Wisconsin under the designation Bowguard 360. Moreover, various systems for locking mount 10 in its stable or locked positions may be envisioned, including locking pins cooperating with corresponding apertures, and similar arrangements of a type common in the art.

What is claimed is:

1. A mount for securing a trolling motor to a boat comprising:

a mounting bracket adapted to be secured to the boat, the bracket including a first pivot support, and a second pivot support wherein the first pivot support is disposed substantially vertically above the second pivot support;

first and second link arms pivotally supported on the first and second pivot supports respectively;

a motor support adapted to receive and hold a portion of the motor, the motor support being pivotally supported on the first and second link arms and movable with the link arms between a deployed position and a stowed position; and a locking mechanism for selectively maintaining the motor support in at least three stable positions including the deployed position, the stowed position and at least one intermediate position between the deployed and stowed positions;

wherein the first and second link arms move the motor support through first and second phases of movement between the deployed position and the stowed position, the motor support being moved in substantially vertical translation in the first phase of movement and in substantially pivotal translation in the second phase of movement.

2. The mount of claim 1, wherein bracket, the first and second link arms and the motor support define a four bar linkage.

3. The mount of claim 1, wherein the locking mechanism includes a spring-biased locking member that engages detents to maintain the motor support discretely in the at least three stable positions.

4. The mount of claim 1, wherein the at least one intermediate position corresponds to location of the motor support in the second phase of movement thereof.

5. The mount of claim 1, wherein the motor support includes a clamp for selectively locking the motor in raised and lowered positions.

6. An apparatus for securing an outboard trolling motor to a boat comprising:

a mounting bracket adapted to be fixed to the boat, the bracket including a first pivot support and a second pivot support wherein the first pivot support is disposed substantially vertically above the second pivot support;

an upper link arm and a lower link arm, the upper and lower link arms being pivotally coupled to the first and second pivot supports respectively; and a motor support configured to receive and support a portion of the motor, the motor support being pivotally coupled to the upper and lower link arms and movable with the link arms between a lowered position and a raised position, the link arms moving the motor support through first and second phases of movement between the lowered position and the raised position, such that a motor mounted in the motor support undergoes substantially vertical translation during the first phase of movement and substantially pivotal translation during the second phase of movement.

7. The apparatus of claim 6, further comprising a locking mechanism for selectively locking the motor support in the lowered position, the raised position and at least one intermediate position.

8. The apparatus of claim 7, wherein the at least one intermediate position corresponds to a location of the motor mount in the second phase of movement thereof.

9. The apparatus of claim 7, wherein the locking mechanism includes a locking member biased into engagement with detents in the upper link arm.

10. The apparatus of claim 6, wherein the first and second pivot supports are disposed outboard of the boat when the mounting bracket is fixed thereto.

11. The apparatus of claim 6, wherein some degree of nesting of the upper and lower link arms occurs when the motor support is in the raised position.

12. An apparatus for securing a motor to a boat, the apparatus comprising:

a first member configured for attachment to the boat, the first member including a mounting bracket having an upper clevis and a lower clevis;

a second member configured for attachment to the motor, the second member including a motor support for receiving a shaft of the motor, the motor support having an upper frame extension and a lower frame extension;

a third member having a first end pivotally coupled to the first member at a first pivot axis and a second end pivotally coupled to the second member at a second pivot axis, the third member being coupled to the upper clevis and the lower frame extension; and a fourth member having a first end pivotally coupled to the first member at a third pivot axis and a second end pivotally coupled to the second member at a fourth pivot axis, the fourth member being coupled to the lower clevis and the lower frame extension;

wherein the first pivot axis is located substantially vertically above the third pivot axis, and the first, second, third and fourth members cooperate to selectively move the motor between a deployed position wherein the motor is in a substantially vertical orientation and a stowed position wherein the motor is in a substantially horizontal orientation.

13. The apparatus of claim 12, further comprising retaining means for selectively retaining the motor in the deployed position, the stowed position and at least one intermediate position therebetween.

14. The apparatus of claim 12, wherein the upper arm has a first recess formed between the first and second ends thereof and the lower arm has a second recess formed between the first and second ends thereof, the lower arm being partially received within the first recess and the motor shaft being partially received within the second recess during selective movement of the motor support from the deployed position to the stowed position.

15. The apparatus of claim 12, wherein the third and fourth members are generally angled, whereby the second and fourth pivot axes are disposed outboard of the first and third pivot axes, respectively, when the motor is in the deployed position.

16. An apparatus of claim 12, further comprises a release assembly, the release assembly including a locking member biased into engagement with at least one detent in the third member to retain the motor in at least one locked position.

* * * * *